US005137434A

United States Patent [19]

Wheeler et al.

[11] Patent Number: 5,137,434

[45] Date of Patent: Aug. 11, 1992

[54] UNIVERSAL MOTOR OILLESS AIR COMPRESSOR

[75] Inventors: Roger D. Wheeler; Mark W. Wood, both of Jackson, Tenn.

[73] Assignee: DeVilbiss Air Power Company, Jackson, Tenn.

[21] Appl. No.: 592,602

[22] Filed: Oct. 4, 1990

[51] Int. Cl.[5] ..... F04B 21/00

[52] U.S. Cl. ..... 417/368; 417/415

[58] Field of Search ..... 417/366, 368, 362, 371, 417/415, 571; 55/437, 438, 17

[56] References Cited

U.S. PATENT DOCUMENTS

| | | | |
|---|---|---|---|
| 1,187,031 | 6/1916 | Black et al. | 417/368 X |
| 2,279,620 | 4/1942 | Hirschmann | 417/368 |
| 2,283,025 | 5/1942 | Wolfert | 417/372 |
| 3,255,779 | 6/1966 | Russell | 417/362 X |
| 4,492,533 | 1/1985 | Tsuge | 417/372 |
| 4,527,387 | 7/1985 | Lastrina et al. | 60/39.092 |
| 4,527,960 | 7/1985 | DeSisto | 417/423.2 X |
| 4,529,365 | 7/1985 | Schutt et al. | 417/415 X |
| 4,869,641 | 9/1989 | Hufgard | 417/368 X |
| 5,055,010 | 10/1991 | Logan | 417/410 |

FOREIGN PATENT DOCUMENTS

| | | | |
|---|---|---|---|
| 0050770 | 5/1982 | European Pat. Off. . | |
| 1503435 | 8/1970 | Fed. Rep. of Germany . | |
| 3335725 | 4/1985 | Fed. Rep. of Germany | 417/571 |
| 47111 | 4/1979 | Japan | 417/571 |
| 617986 | 6/1980 | Switzerland . | |

*Primary Examiner*—Leonard E. Smith

*Attorney, Agent, or Firm*—MacMillan, Sobanski & Todd

[57] ABSTRACT

An improved oilless air compressor which is driven by a high speed universal motor. A sprocket and belt driven pulley are arranged to reduce the compressor speed. A motor driven fan and baffles are provided to direct cooling air in predetermined sequences over the motor and compressor components to increase the operating life of the compressor components, to optimize the compressor efficiency and to reduce the temperature of the compressed air output. The compressor is provided with improved intake and exhaust valves.

9 Claims, 7 Drawing Sheets

UNIVERSAL MOTOR OILLESS AIR COMPRESSOR

TECHNICAL FIELD

The invention relates to air compressors and more particularly to an improved oilless air compressor which is driven by a universal motor.

BACKGROUND ART

Various constructions are known for air compressors used, for example, for driving pneumatic tools, paint spray guns, air dusters, and the like. In one type of compressor, a piston is mounted to reciprocate in a cylinder. The piston is connected through a connecting rod to an eccentrically rotated crank which causes the piston to reciprocate. The piston may be cylindrically shaped and confined to slide in the cylinder, in which case a wrist pin provides a pivotal connection between the piston and the connecting rod. This construction requires constant oil lubrication during operation. Or, the piston may be rigidly secured to the connecting rod and designed to rock or tilt as it is reciprocated in the cylinder, as is shown, for example, in U.S. Pat. Nos. 3,961,869, 4,028,015, 4,540,352 and 4,848,213. A resilient seal is secured to the piston to allow it to slide and to tilt while maintaining a gas tight seal between the piston and the cylinder. Since the seal does not require constant lubrication, this construction is sometimes referred to as an "oilless" compressor. The operating life of the seal is related to the maximum temperature to which the seal is subjected during operation.

Most compressors are driven at relatively low speeds by synchronous alternating current electric motors. For example, a motor operated from 60 Hz. power typically operates at about 1,700 rpm and the compressor speed may be further reduced by a belt and pulley drive. A synchronous motor may have difficulty in starting a loaded compressor. The reciprocating piston and other moving components for oil lubricated compressors are relatively massive and not suitable for operation at high speeds, for example, as are achieved by non-synchronous universal motors. It is believed that higher operating speed universal motors have not been used for driving larger oilless compressors because the heat produced by the motor can significantly reduce the life of compressor components such as the sliding piston seal and of a drive belt and the noise caused by a high speed gear reduction system is objectionable.

DISCLOSURE OF INVENTION

The invention relates to an air compressor assembly including an oilless air compressor driven by a high speed universal motor. The compressor and motor are enclosed in a compact housing. The universal motor has a stator and a rotor supported on a drive shaft having first and second ends. The commutator and brushes are located at the first end along with a cooling air fan blade. The second shaft end is connected through a small diameter sprocket, a drive belt, a large diameter pulley and an eccentric to reciprocate a piston in a cylinder. The cylinder is closed by a valve plate assembly and a cylinder head. The piston is provided with a seal which slides in the cylinder without liquid lubrication.

The valve plate assembly for the air compressor includes novel air intake and air exhaust valves. The valves are of the reed or flapper type. A restrictor attached to the valve plate adjacent the intake valve provides a progressively increasing valve spring rate as intake valve deflection increases. Deflection of the exhaust valve is restricted by the shape of the cylinder head which minimizes valve impact vibrations and corresponding valve stress.

Baffles are provided to separate the air flow from the fan blade into first, second and third air flows. A first air flow passes sequentially over the motor commutator/-brushes, between the rotor and stator and over the exterior walls of the cylinder. A second air flow is directed over the cylinder and head assembly and a third air flow is directed over the drive belt. By splitting the air into different flow paths, the drive belt and the cylinder and head assembly are not subjected to heat from the motor. The temperature of the drive belt and the temperature of the sliding piston seal are maintained at a minimum to extend their operating life. A portion of the air flowing over the valve plate assembly and over the cylinder head is diverted into an air intake for the compressor. The diverted air abruptly changes flow directions from the remainder of the air in the second flow. Any particles in such second flow of air are diverted from the compressor intake as a consequence of their inertia. After cooling the motor and compressor, a portion of the air is passed over a coiled tube which connects between the air compressor outlet and an air hose. This air flow cools the compressed air to increase the life of the air hose and to reduce the burn risk for a user of the air compressor.

Accordingly, it is an object of the invention to provide an improved electrically driven oilless air compressor.

Other objects and advantages of the invention will be apparent from the following detailed description and the accompanying drawings.

BEST MODE FOR CARRYING OUT THE INVENTION

Figure 1:
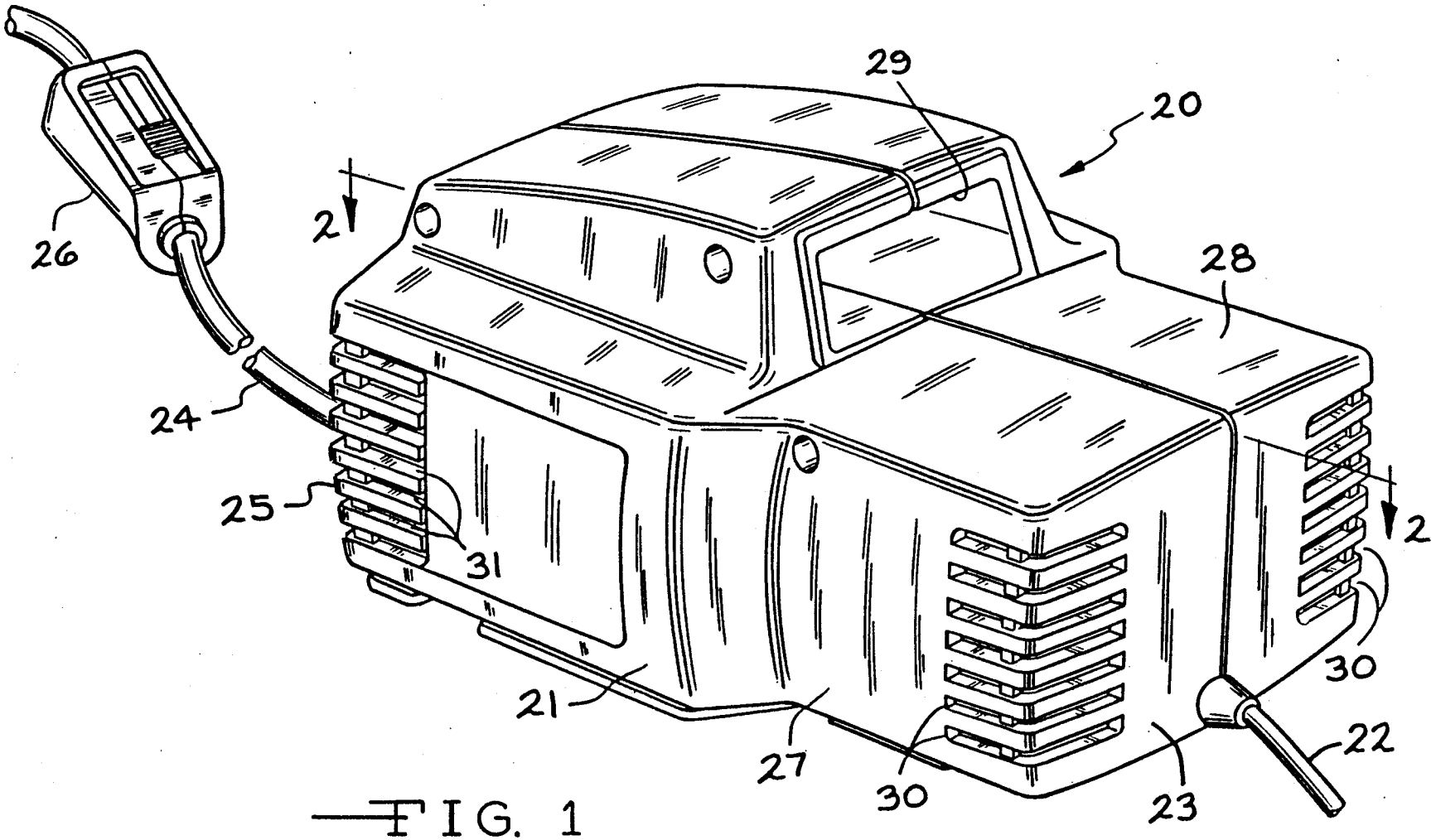
FIG. 1 is a perspective view of a compact oilless air compressor assembly constructed in accordance with the invention.

Referring to FIG. 1 of the drawings, a compact air compressor assembly 20 is shown according to the invention. The air compressor assembly 20 has a compact molded plastic housing 21 with a power cord 22 (shown in fragmentary) extending from one end 23 and a compressed air outlet hose 24 (also shown in fragmentary)

extending from an opposite end 25. A pressure regulating valve 26 is located in the air hose 24. The air compressor assembly 25 is designed to provide an unregulated compressed air output. The valve 26 is set to establish a desired output pressure. Any excess air pressure is vented to atmosphere through the pressure regulating valve 26. The housing 21 is formed from two shroud halves 27 and 28 and defines an integral carrying handle 29. The shroud halves 27 and 28 are secured together by, for example, a plurality of screws (not shown). A plurality of ambient air intake slots 30 are formed in the housing 21 adjacent the end 23 and a plurality of exhaust air slots 31 are formed in the housing 21 adjacent the end 25. As will be described in detail below, ambient air is drawn through the intake slots 30, caused to cool the internal components of the air compressor assembly 20 in a predetermined sequence to optimize the efficiency and operating life of the air compressor assembly 20, and the warmed air is exhausted through the slots 31.

Figure 2:
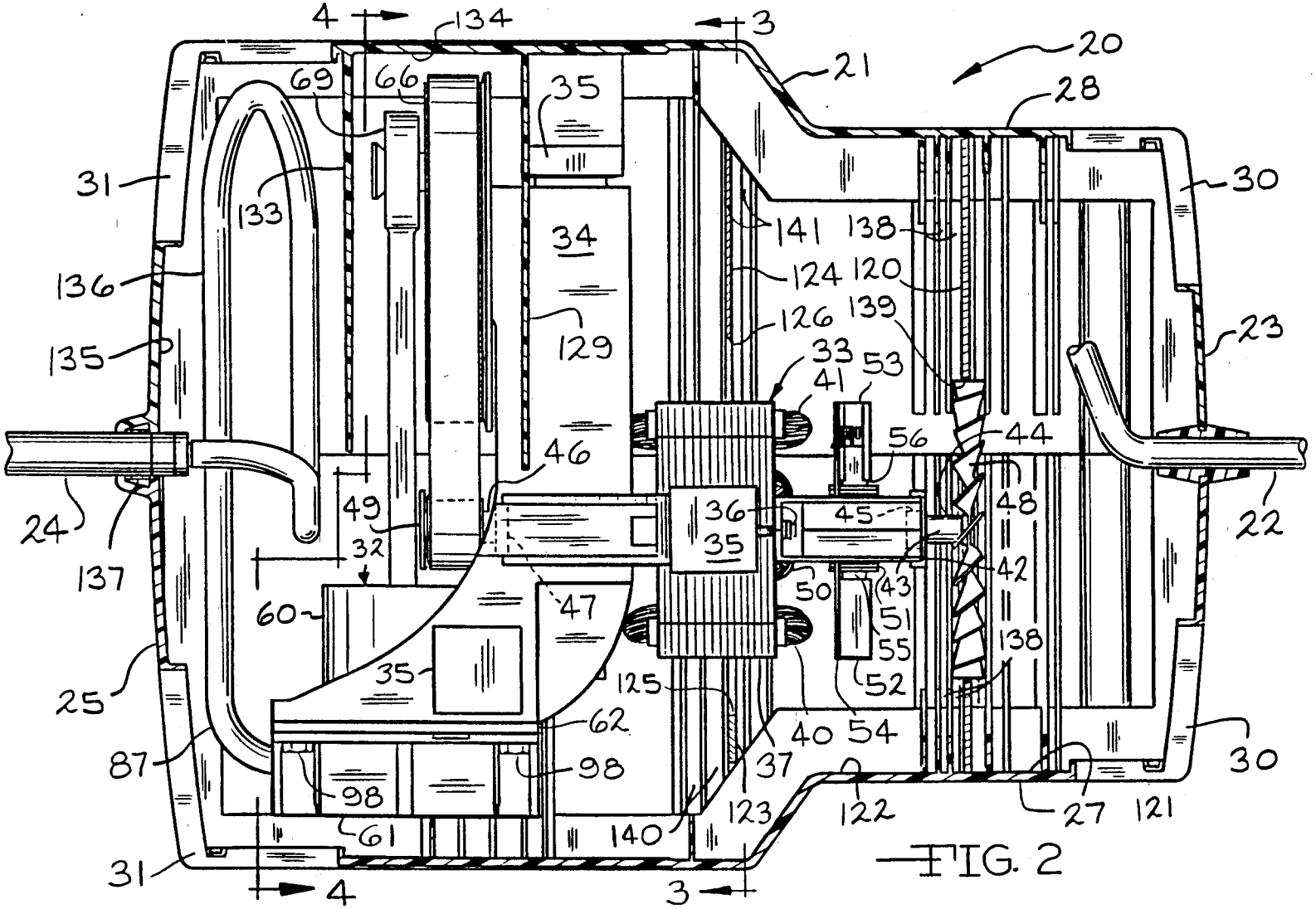
FIG. 2 is a cross sectional view through the air compressor assembly as taken along line 2—2 of FIG. 1.

FIG. 2 shows a cross sectional view through the air compressor assembly 20. The assembly 20 includes an air compressor 32 driven by a non-synchronous universal motor 33, as distinguished from the conventional synchronous motor used to drive compressors. The air compressor 32 and the motor 33 are mounted on a bracket 34. A plurality of resilient pads 35 are positioned between the bracket 34 and the shroud halves 27 and 28 to resiliently mount the bracket 34 in the housing 21. The pads 35 are elastomeric isolators which reduce the transmission of sound and vibrations from the compressor 33 and the motor 34 to the housing 21. The pads 35 also provide protection to the air compressor assembly 20 during shipping. Bolts 36 secure the universal motor 33 to the bracket 34.

Figure 3:
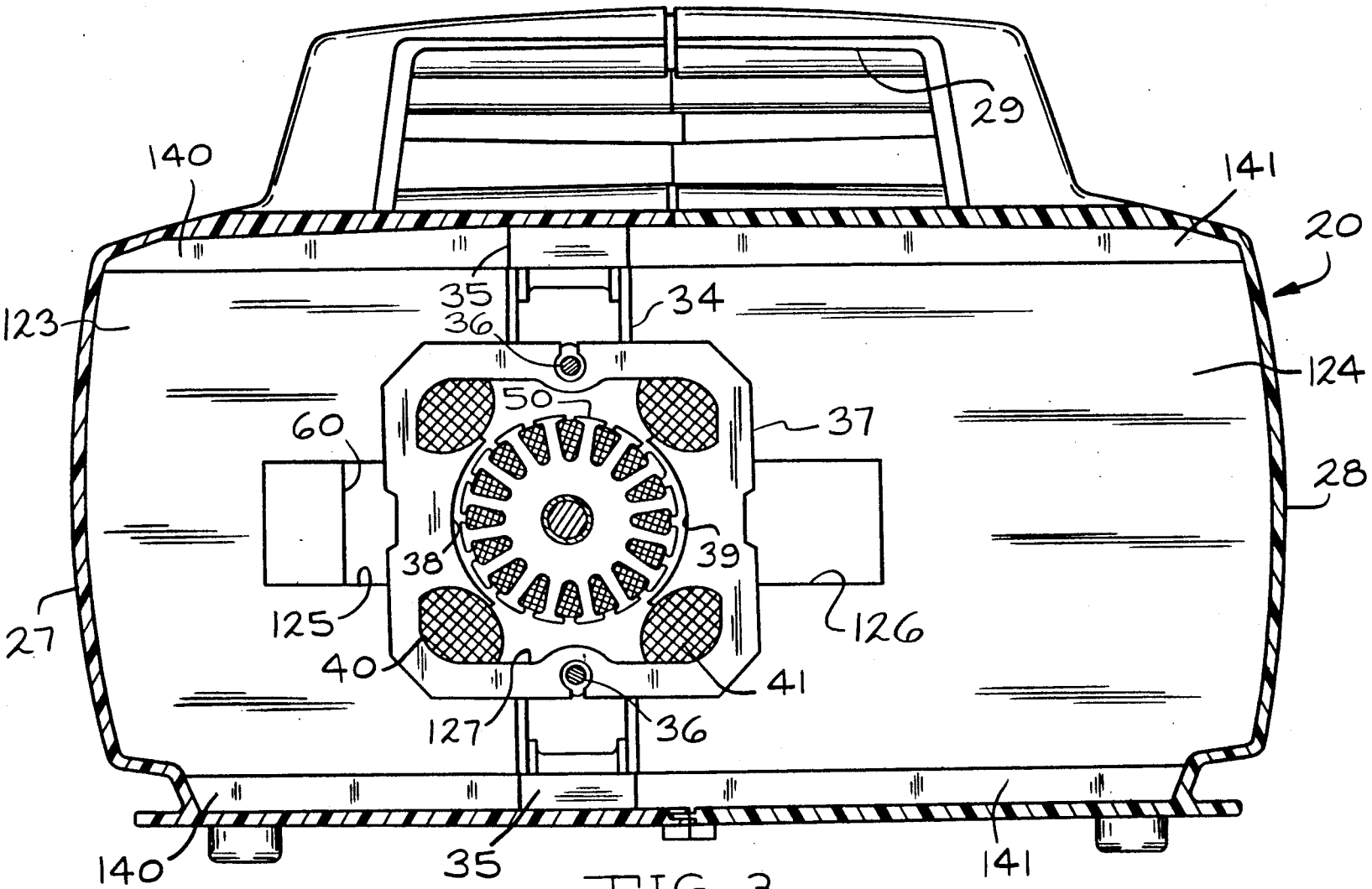
FIG. 3 is a cross sectional view as taken along line 3—3 of FIG. 2.

As shown in FIGS. 2 and 3, the motor has a stator 37 with two poles 38 and 39 on which two coils 40 and 41 are wound, respectively. The bolts 36 secure the stator 37 and a motor frame 42 to the bracket 34. A shaft 43 is supported adjacent an end 44 by a bearing 45 secured to the frame 42 and is supported adjacent an end 46 by a bearing 47 secured to the bracket 34. A fan blade 48 is secured to the shaft end 44 and a sprocket 49 is secured to the shaft end 46. A rotor 50 and a commutator 51 are mounted on the shaft 43. The rotor 50 is located within the stator 37 and the commutator 51 is located within the frame 42. Two brush holders 52 and 53 are mounted on a board 54 which is secured to the frame 42. Spring loaded brushes 55 and 56 in the holders 52 and 53, respectively, are urged into contact with opposite sides of the commutator 51. When power is applied to the motor 33, the shaft 43 rotates at a high speed to in turn drive the sprocket 49 and the fan blade 48.

Figure 4:
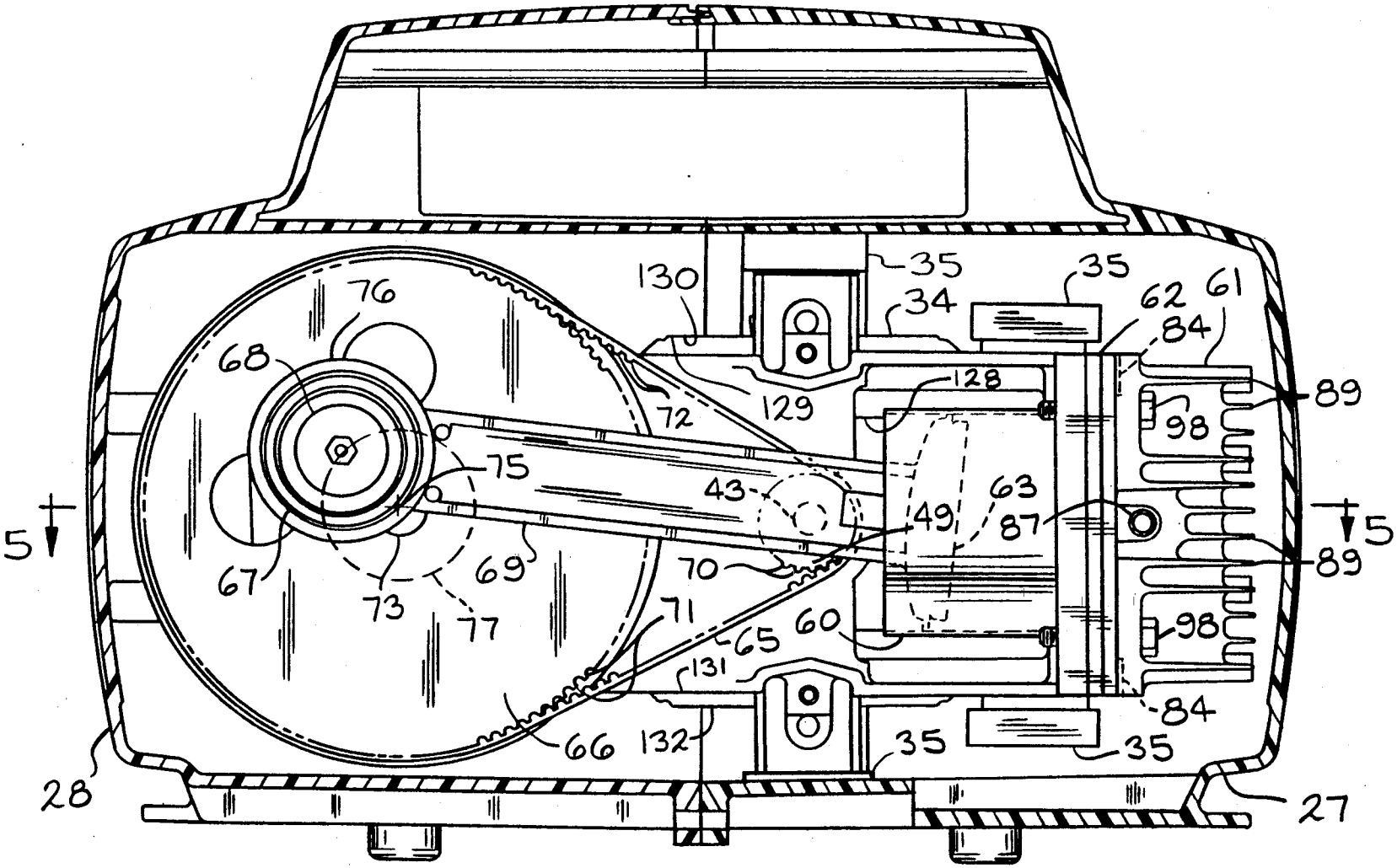
FIG. 4 is a cross sectional view as taken along line 4—4 of FIG. 2.
Figure 5:
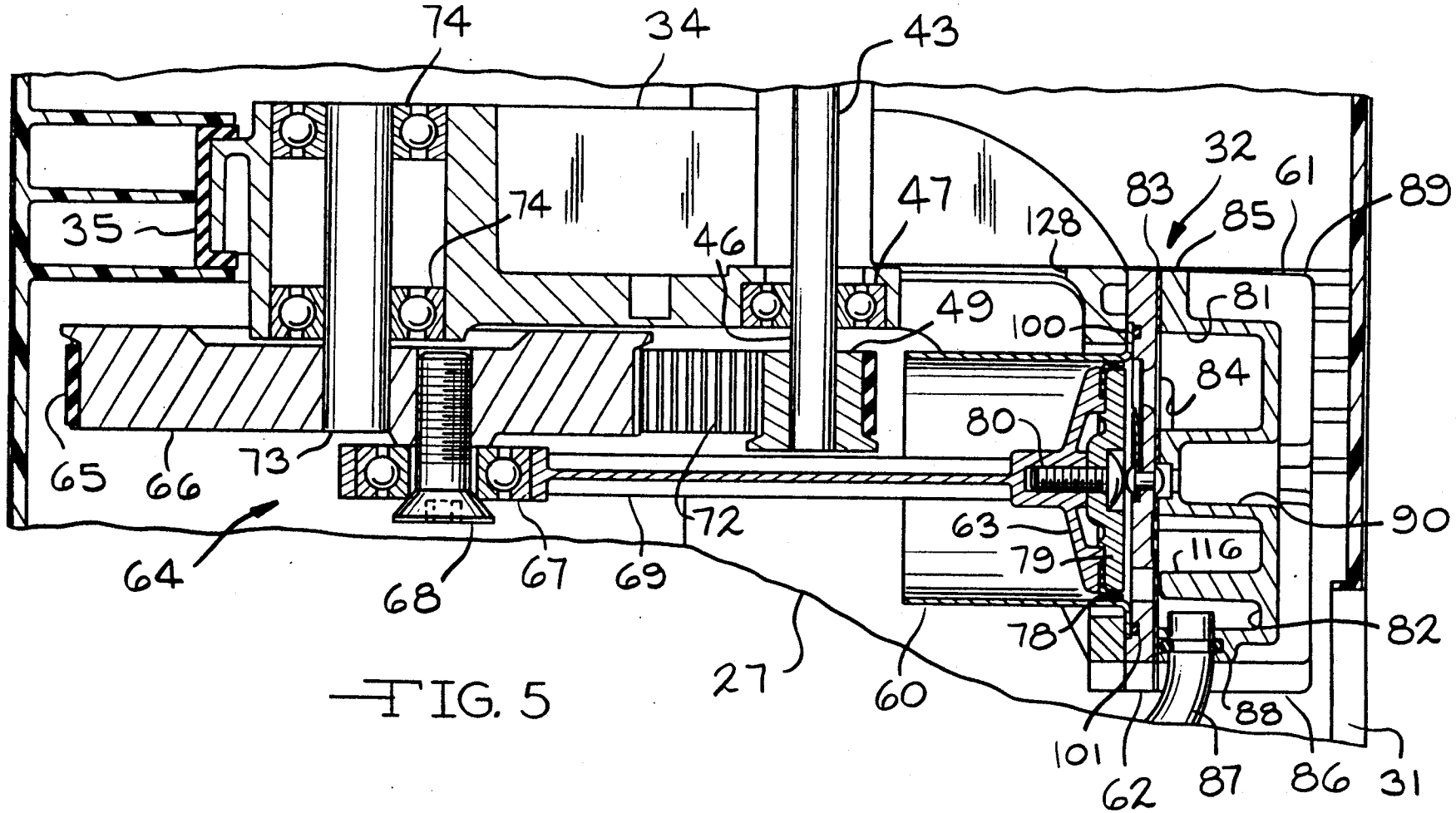
FIG. 5 is a fragmentary cross sectional view as taken along line 5—5 of FIG. 4, but with the piston shown at top dead center.

Details of the compressor 32 are shown in FIGS. 2, 4 and 5. The compressor 32 generally includes a cylinder 60, a head 61, a valve plate assembly 62 mounted between the cylinder 60 and the head 61, and a piston 63 which is reciprocated in the cylinder 60 by an eccentric drive 64. The eccentric drive 64 includes the sprocket 49, a drive belt 65, a pulley 66, a bearing 67 eccentrically secured to the pulley 66 by a screw 68 and a connecting rod 69. Preferably, the sprocket 49 and the pulley 66 are provided with teeth 70 and 71, respectively, spaced around their perimeters and the drive belt 65 is a timing belt having corresponding teeth 72 which prevent slippage between the sprocket 49 and the pulley 66 during high loads. The pulley 66 is mounted on a shaft 73 which is supported from the bracket 34 by bearings 74. The bearings 74 allow the pulley 66 to be rotated about an axis 75 when the motor rotates the sprocket 49. As the pulley 66 rotates about the axis 75, the screw 68, the bearing 67 and an attached end 76 of the connecting rod 69 are moved around a circular path 77.

The non-synchronous universal motor 33 operates at speeds much higher than a conventional synchronous motor. Depending upon the load, the design rating of the motor 33 and the operating voltage, the motor 33 may operate, for example, between 10,000 rpm and 20,000 rpm. The pulley 66 and the sprocket 49 are sized to significantly reduce the speed at which the piston 63 is reciprocated. For example, if the sprocket 49 has a diameter of 1 inch and the pulley 66 has a diameter of 4 inches, a motor 33 speed of 14,000 rpm will be reduced to a piston speed of 3,500 strokes per minute.

The piston 63 is formed as an integral part of the connecting rod 69. A sliding compression seal 78 is attached to the piston 63 by a retaining ring 79 and a screw 80. Preferably, the seal 78 is formed from a combination of bronze, molybdenum disulfide and polytetrafluoroethylene (Teflon), although other known seal materials may be used. The interior wall of the cylinder 60 is formed with a smooth finish to increase the life of the seal 78. It should be noted that since the piston 63 is integral with the connecting rod 69, the design of the seal 78 must be effective when the piston 63 rocks or tilts during reciprocation.

The cylinder head 61 is shaped to define an air inlet chamber 81 and a compressed air outlet chamber 82. A gasket 83 forms an air tight seal between the head 61 and the valve plate assembly 62 to prevent leakage of high pressure gas from the outlet chamber 82. The inlet chamber 81 is connected to atmosphere by two inlet ports 84 which connect from the chamber 82 between the head 61 and the gasket 83 to atmosphere. Air entering the inlet ports 84 is not filtered. However, the inlet air is diverted from a high speed flow of cooling air flowing over top and bottom sides 85 and 86, respectively, of the head 61. The inlet air must make a substantial change in direction from the flow of cooling air. Any dust and other particles dispersed in the flow of cooling air have sufficient inertia that they tend to continue moving with the cooling air rather than change direction and enter the inlet ports 84. Consequently, the inlet air is filtered through inertia. The outlet chamber 82 is connected through a compressed air outlet tube 87 to the air hose 24. A suitable seal 88 is located between the tube 87 and the cylinder head 61. Preferably, the seal 88 is of the type disclosed in U.S. patent application Ser. No. 07/467,799. A plurality of cooling fins 89 over which a flow of cooling air is passed are formed on the exterior walls of the cylinder head 61 adjacent the inlet chamber 81 and the outlet chamber 82. Preferably, the walls of the inlet chamber 81 and the adjacent fins 89 are separated by a space 90 from the walls of the outlet chamber 82 and the adjacent fins 89. The space 90 reduces heat transfer from the hot compressed air in the outlet chamber 82 to the cooler intake air in the inlet chamber 81 to prevent any decrease in the volumetric efficiency of the air compressor 32.

The air compressor 32 has an improved valve plate assembly 62 which is shown in detail in FIGS. 5-8. The valve plate assembly 62 includes a generally flat plate 95 which mounts intake valves 96 and outlet valves 97. The valve plate 95 is clamped to the bracket 34 by four screws 98 which pass through the head 61, the gasket 83 and through holes 99 in the valve plate 95 and engage the bracket 34. A radial flange 100 on the cylinder 60 is clamped between the valve plate 95 and the bracket 34 to mount the cylinder 60. An O-ring seal 101 is located in a groove 102 in the valve plate 95 for forming a gas tight seal between the valve plate 95 and the cylinder flange 100.

Figure 6:
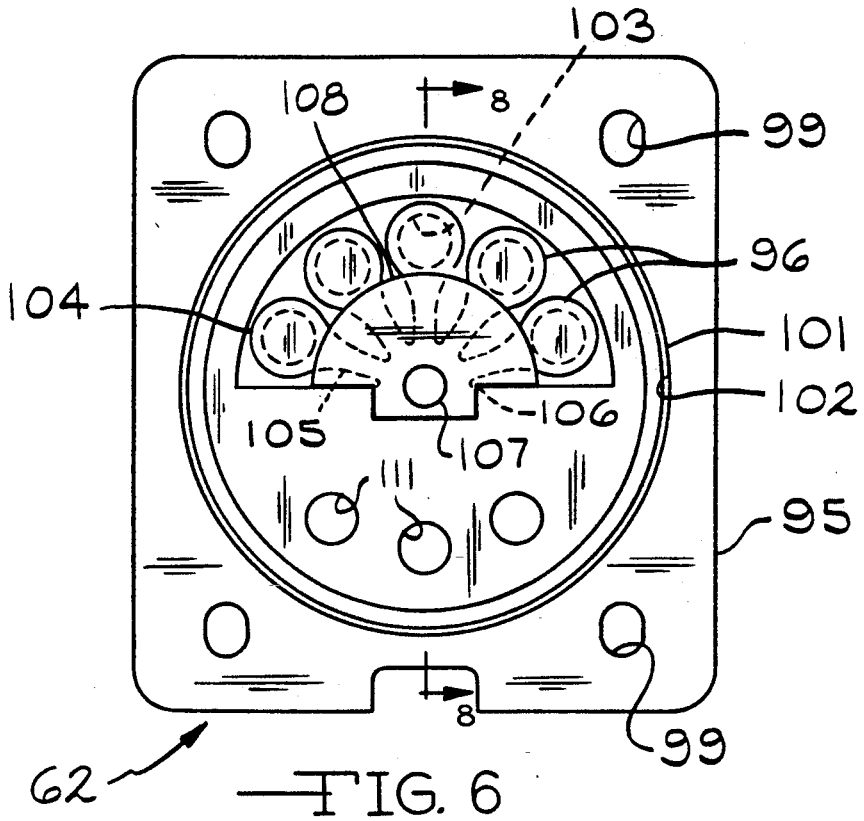
FIG. 6 is a bottom plan view of the valve plate assembly for the air compressor.
Figure 7:
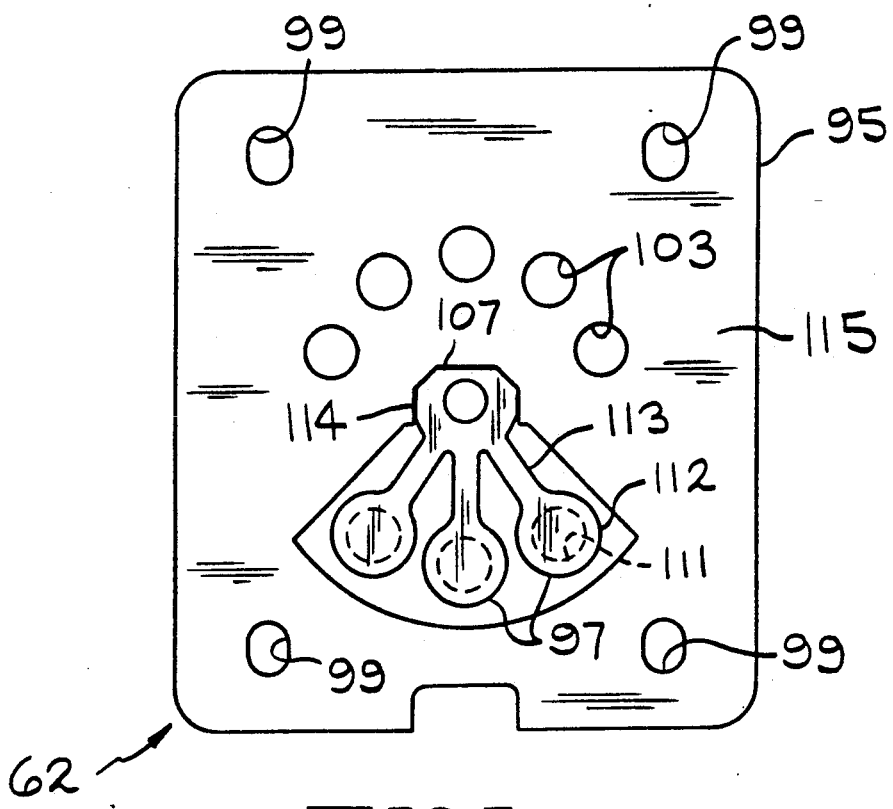
FIG. 7 is a top plan view of the valve plate assembly of FIG. 6.
Figure 8:
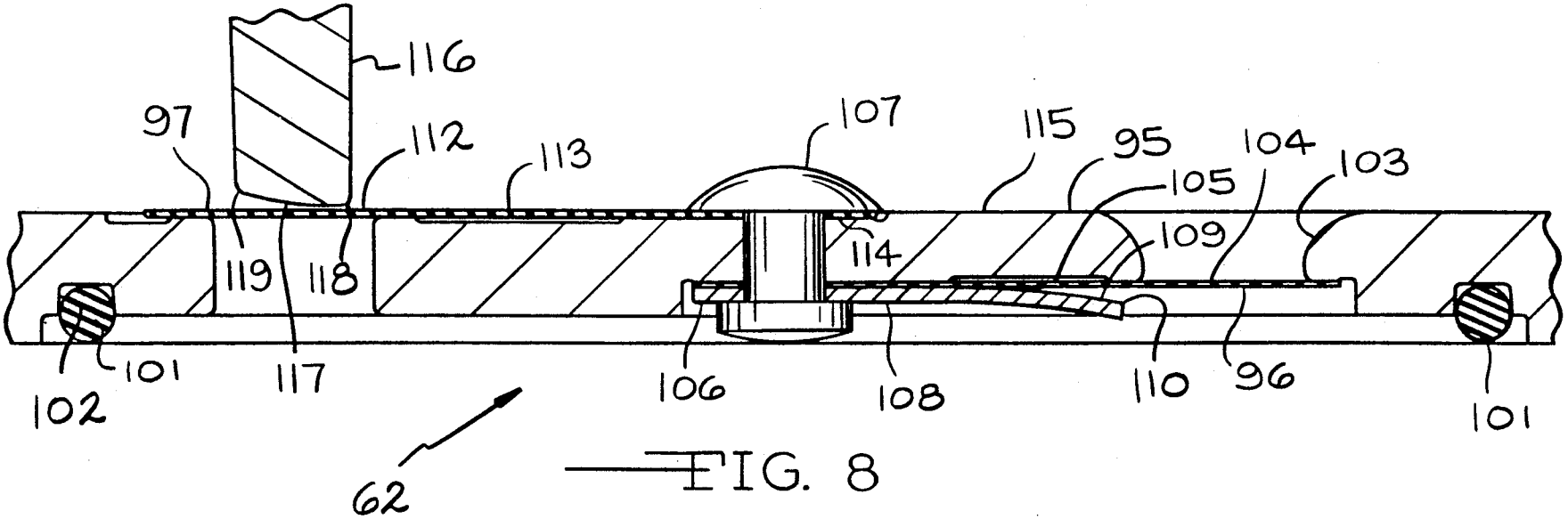
FIG. 8 is a fragmentary cross sectional view through the valve plate assembly, as taken along line 8—8 of FIG. 6, and also showing a portion of the cylinder head adjacent the outlet valve.

The valve plate 95 has a plurality of inlet ports 103 (5 shown) which are normally closed by the intake valves 96. The intake valves 96 are of the reed or "flapper" type and are formed, for example, from a thin sheet of resilient stainless steel. Each port is covered by a separate circular valve member 104. Fingers 105 radiate from a hub 106 to connect the valve members 104 and to function as return springs. A rivet 107 secures the hub 106 to the center of the valve plate 95. An intake valve restrictor 108 is clamped between the rivet 107 and the hub 106. As best seen in FIGS. 6 and 8, the restrictor 108 has a slightly curved or dish shaped surface 109 which is curved in a direction extending radially from the rivet 107. The surface 109 terminates at an edge 110 which has a roll-over radius. When air is drawn into the cylinder 60 during an intake stroke of the piston 63, the fingers 105 bend and the valve members 104 separate from the valve plate 95 to allow air to flow through the inlet ports 103. The resiliency of the fingers 105 serves as return springs for urging the valve members 104 against the valve plate 95. As the deflection of the valve members 104 increases, a greater portion of the fingers 105 contact the curved restrictor surface 109. This results in a progressively increasing valve spring rate which urges the valve members 104 towards a closed position seated on the valve plate 95 with increasing force as deflection increases.

The valve plate 95 also has a plurality of exhaust ports 111 (3 shown) which are normally closed by the outlet valves 97. Less exhaust port 111 area is required than inlet port 103 area because the volume flow of the compressed exhaust gas is less than the volume flow of the ambient pressure intake gas. The valves 97 are preferably formed from a thin sheet of resilient stainless steel. The outlet valves 97 consist of a separate circular valve member 112 for each port 111. The valve members 112 are connected through radial resilient fingers 113 to a hub 114. The hub 114 is secured to a top side 115 of the valve plate 95 by the rivet 107. The fingers 113 serve as springs for urging the valve members 112 against the valve plate 95 to close the ports 111. As best seen in FIGS. 5 and 8, the cylinder head 61 has an integral cast annular rib 116 which projects over and is spaced slightly from the valve members 112. The rib 116 has a lower surface 117 which is curved slightly in a direction of increased distance from the rivet 107. Thus, an edge 118 of the lower surface 117 located closest to the rivet 107 is closer to the valve members 112 than a lower surface edge 119 located furthest from the rivet 107. The edges 118 and 119 are rounded to prevent stress points when the valve members 112 contact the rib 116. The rib 116 restricts movement of the exhaust valve members 112 to minimize valve impact vibrations and corresponding valve stress.

When mounting a relatively high capacity air compressor in a small housing, adequate cooling is critical to the operating life of the compressor 32 and the motor 33. Sources of heat in the motor 33 include the commutator 51 and brushes 55 and 56, the stator coils 40 and 41 and coils in the rotor 50. In the compressor 32, heat is produced by the air as it is compressed in the cylinder 60 and by the flexing drive belt 65. The fan blade 48 establishes a forced flow of cooling air through the housing 21. According to one feature of the invention, baffles are strategically located to split the cooling air into several streams for providing maximum cooling to critical components in the air compressor assembly 20. Both fixed and adjustable baffles are used to accommodate different size motors within a single housing design. The baffles are best seen in FIGS. 2 and 3. A baffle 120 is positioned in the housing 21 to surround the fan blade 48. The baffle 120 forms an air intake chamber 121 in the housing 21 which communicates with the intake air slots 30. The baffle 120 also causes the intake air to flow from the chamber 121 to a chamber 122 which will be maintained above atmospheric pressure by the rotating fan blade 48. Because the assembly 20 uses a universal motor 33, the fan blade 48 is rotated at a very high speed and the resulting air flow is appreciably higher than would otherwise be obtainable in a comparable air compressor operating at a lower speed.

Two baffle sections 123 and 124 are mounted in the shroud halves 27 and 28, respectively, to extend between the shroud halves 27 and 28 and the motor stator 37. As best shown in FIG. 3, an air passage 125 is formed in the baffle section 123 adjacent the stator 37 and an air passage 126 is formed in the baffle section 124 adjacent the stator 37. As previously indicated, the motor 33 includes the stator 37, the windings 40 and 41 and a rotor 50. An open passageway 127 extends in an axial direction through the motor 33 between the stator 37 and the rotor 50. A first portion of the air delivered by the fan blade 48 to the chamber 122 flows along a first path in sequence first over the commutator 51 and brush assembly including the brushes 55 and 56 and the brush holders 52 and 53, then through the motor passageway 127, then through an opening 128 (best seen in FIGS. 4 and 5) in the bracket 34, over the walls of the cylinder 60 and finally through the exhaust air slots 31. This first flow of air picks up heat from the motor 33 and then from the cylinder 60 before being discharged through the housing slots 31.

A second portion of air from the chamber 122 passes through the passage 125 in the baffle 123, through the bracket opening 128, over the cylinder head 61 and is exhausted through the housing slots 31. The second flow of air picks up very little heat from the motor 33 and, consequently, is more effective in removing heat from the cylinder head 61 than it would be if previously warmed by the motor 33. A portion of this cooler flow of air also is diverted to the compressor inlet ports 84. Since the compressor inlet air is not substantially heated by the motor 33, the volumetric efficiency of the compressor 32 is not significantly affected by the heat of the motor 33.

A third portion of the air from the chamber 122 flows through the passage 126 in the baffle 124. Some of this air flows through the bracket opening 128. An upper baffle 129 extends from the housing 21 to adjacent the bracket 34, leaving an upper vent space 130 extending along the bracket 34. A lower baffle 131 also extends from the housing 21 to adjacent the bracket 34, leaving a lower vent space 132 extending along the bracket 34. Air in the third flow also passes through the vent spaces 130 and 132 and over the drive belt 65. Air in the third flow is not significantly heated by the motor 33 and is at substantially ambient temperature when it flows over and cools the drive belt 65. The third flow of ambient temperature air cools the drive belt 65 to extend its operating life.

A fixed baffle 133 separates two chambers 134 and 135 in the shroud half 28. The chamber 134 is located between the baffles 129 and 131 and the bracket 34 on one side and the baffle 133 on the other side. The chamber 135 is formed between the baffle 133 and the housing end 25. A portion of the drive belt 65 and the pulley 66 are located in the chamber 134. The compressed air outlet tube 87 extends from the compressor head 61 through a loop 136 located in the chamber 135 and is connected to the hose 24 by a hose clamp 137. The tube 87 preferably is formed from a good heat conducting material, such as aluminum. The tube loop 136 in the chamber 135 forms an aftercooler for the hot compressed air. Some of the cooling air circulated through the housing 21 by the fan blade 48 flows around the baffle 133 and through the chamber 136 to the exhaust air slots 31. This air flow cools the compressed air as it flows to the hose 24. Cooling the compressed air extends the life of the air hose 24 and also lowers the exterior temperature of the hose 24 to prevent burn risk and to enhance safety. The tube loop 136 also reduces vibration stress to the tube 87 between the compressor 32 and the air hose 24.

The air compressor assembly 20 is designed to accommodate different design universal motors 33. The different motors 33 may come from different manufacturers or they may be of different horsepower ratings. For example, although the housing 21 is compact, it can accommodate universal motors 33 rated, for example, at ½ horsepower, at ¾ horsepower or at 1 horsepower merely by changing the design and location of the baffles 120, 123 and 124. The shroud halves 27 and 28 are provided with a plurality of slots 138 for mounting the baffle 120 at different spacings from the housing end 23. By changing the dimension and location of an opening 139 in the baffle 120 for the fan blade 48 and by properly selecting the slots 138 for supporting the baffle 120, different fan blade 48 dimensions and locations may be accommodated. Similarly, a plurality of slots 140 are arranged in the shroud half 27 for mounting the baffle 123 at different spacings between the housing ends 23 and 25 and a plurality of slots 141 are arranged in the shroud half 28 for mounting the baffle 124 at different spacings between the housing ends 23 and 25. The baffles 123 and 124 will be shaped to conform to the particular motor 33 being used in the assembly 20. The motor 33 and the compressor 32 are mounted on the bracket 34 and are not in contact with the housing 21. The bracket 34 is supported at a fixed location in the housing 21 by the resilient pads 35. Consequently, attaching a different size or design motor 33 to the bracket 34 does not affect the mounting of the motor 33 in the housing 21.

It will be appreciated that various modifications and changes may be made to the above described preferred embodiment of an air compressor assembly 20 having a universal motor 33 without departing from the spirit and the scope of the following claims.

I claim:

1. In an air compressor assembly including an air compressor, a fan blade, an electric motor and a housing enclosing said air compressor, said fan blade and said motor, said motor driving said compressor, and said motor driving said fan blade to establish a flow of ambient cooling air through said housing, the improvement comprising baffle means diverting a first flow of such ambient cooling air to cool said motor and diverting at least one second flow of such ambient cooling air flow separate from said first air flow to cool said compressor, said baffle means further including means for causing a first portion of said second air flow of such ambient air flow to cool a cylinder and head assembly on said compressor and means for causing a second portion of said second flow of such ambient air flow to cool a drive belt for said compressor.

2. An improved air compressor assembly, as set forth in claim 1, wherein said first portion of said second flow of ambient air flows at a predetermined high velocity over an intake port to said compressor, and wherein a portion of said first portion of said second flow of ambient air is diverted into said intake port.

3. An improved electrically driven air compressor comprising, in combination, an electric motor having a shaft which is rotated about a first axis, said shaft having first and second ends, a fan including a blade mounted on said first shaft end, a sprocket having a first predetermined small diameter mounted on said second shaft end, a pulley having a second predetermined diameter larger then said first predetermined diameter mounted to rotate about a second axis parallel to said first axis, a drive belt connecting said sprocket and said pulley, a connecting rod having a first end and having an integral piston formed at a second end, a cylinder mounted on an axis perpendicular to said first axis, an eccentric connecting said first connecting rod end to said pulley to reciprocate said piston in said cylinder as said pulley rotated, said piston moving alternately between intake strokes and exhaust strokes, means for delivering air to said cylinder during each intake stroke and outlet means for receiving compressed air from said cylinder during each exhaust stroke, said fan including means directing a first high flow of ambient air over and through said motor and means directing at least a portion of a second flow of ambient air separate from said first flow of ambient air over said belt.

4. An improved electrically driven air compressor, as set forth in claim 3, wherein said outlet means includes means for receiving heat from such received compressed air, and including means for exhausting at least a portion of said second flow from said belt over said heat receiving means to atmosphere.

5. An improved electrically driven air compressor, as set forth in claim 3, and further including a cylinder head closing said cylinder, and wherein at least a portion of said second flow of ambient air flows over said cylinder head.

6. An improved electrically driven air compressor, as set forth in claim 5, and wherein said means for delivering air to said cylinder diverts air from the portion of said second flow flowing over said cylinder head.

7. An improved electrically driven air compressor, as set forth in claim 6, wherein said means for delivering air to said cylinder includes means causing a portion of the delivered air in said second flow to abruptly change flow directions relative to the remaining air in said second flow whereby any particles suspended in said second flow are retained in such remaining air flow.

8. An improved electrically driven air compressor, as set forth in claim 7, and further including a valve plate mounted between said cylinder and said cylinder head, wherein said means for delivering air to said cylinder includes an intake valve on said valve plate, wherein said outlet means includes an exhaust valve on said valve plate, and wherein said means for causing a portion of the air in said second flow to abruptly change flow direction includes an air intake passage between said valve plate and said cylinder head, said air intake passage extending substantially perpendicular to the flow direction for such remaining air in said second flow.

9. An improved electrically driven air compressor, as set forth in claim 5, wherein said motor, said sprocket, said pulley, said belt, said piston, said cylinder and said cylinder head are enclosed in a housing and wherein said stator is a universal motor having a rotor and a stator located between said first and second shaft ends and further having brushes and a commutator located adjacent said first shaft end and said means for delivering a first flow of ambient air and said means for delivering a second flow of ambient air includes a baffle positioned between said motor and said housing, said baffle causing ambient air from said fan to flow as said first flow over said brushes and commutator and then between said rotor and said stator and to flow as said second flow over said belt and over said cylinder.

* * * * *